US006536729B1

(12) United States Patent
Haddock

(10) Patent No.: US 6,536,729 B1
(45) Date of Patent: Mar. 25, 2003

(54) BRACKET ASSEMBLY INCLUDING A RESERVOIR

(75) Inventor: Robert M. Haddock, Colorado Springs, CO (US)

(73) Assignee: Robert M. M. Haddock, Colorado Springs, CO (US)

( * ) Notice: Subject to any disclaimer, the term of this patent is extended or adjusted under 35 U.S.C. 154(b) by 0 days.

(21) Appl. No.: 09/313,105

(22) Filed: May 17, 1999

(51) Int. Cl.[7] ..... A47F 5/00; A47H 1/10

(52) U.S. Cl. ..... 248/300; 248/200; 52/204.55

(58) Field of Search ..... 248/200, 205.3, 248/205.4, 220.21; 52/300, 730.6, 731.8, 731.7, 235, 204.55; 428/331

(56) References Cited

U.S. PATENT DOCUMENTS

| | | | | | |
|---|---|---|---|---|---|
| 3,809,799 | A | | 5/1974 | Taylor | 174/68 C |
| 4,141,182 | A | | 2/1979 | McMullen | 52/24 |
| 4,593,877 | A | | 6/1986 | van der Wyk | 248/512 |
| 4,682,454 | A | * | 7/1987 | Simpson | 52/200 |
| 4,810,573 | A | * | 3/1989 | Harriett | 428/331 |
| 4,835,927 | A | * | 6/1989 | Michlovic | 52/400 |
| 4,949,929 | A | | 8/1990 | Kesselman et al. | 248/300 |
| 4,987,699 | A | * | 1/1991 | Gold | 49/375 |
| 5,138,820 | A | * | 8/1992 | Pearce | 52/656 |
| 5,152,107 | A | | 10/1992 | Strickert | 52/24 |
| 5,228,248 | A | | 7/1993 | Haddock | 52/25 |
| 5,392,574 | A | * | 2/1995 | Sayers | 52/217 |
| 5,413,397 | A | * | 5/1995 | Gold | 296/146.15 |
| 5,439,307 | A | | 8/1995 | Steinhilber | 403/267 |
| D364,338 | S | | 11/1995 | Cline | D8/499 |
| 5,483,772 | A | | 1/1996 | Haddock | 52/25 |
| 5,491,931 | A | | 2/1996 | Haddock | 52/25 |
| 5,609,326 | A | | 3/1997 | Stearns et al. | 256/12.5 |
| 5,647,178 | A | | 7/1997 | Cline | 52/219 |
| 5,694,721 | A | | 12/1997 | Haddock | 52/24 |
| 5,715,640 | A | | 2/1998 | Haddock | 52/545 |
| 5,765,310 | A | * | 6/1998 | Gold | 49/375 |
| 5,983,588 | A | | 11/1999 | Haddock | 52/545 |

FOREIGN PATENT DOCUMENTS

| | | | | |
|---|---|---|---|---|
| CH | 469 159 | | 1/1968 | E04D/13/10 |
| CH | 671 063 A5 | | 7/1989 | E04D/13/10 |
| JP | 404366294 | * | 12/1992 | 52/204.55 |

* cited by examiner

*Primary Examiner*—Anita King
*Assistant Examiner*—Gwendolyn Baxter
(74) *Attorney, Agent, or Firm*—Marsh Fischmann & Breyfogle LLP

(57) ABSTRACT

A bracket attachable to a surface while maintaining the impermeability of the surface to fluids. The apparatus includes a base having a cavity or channel on a bottom side. Holes through the base for receiving fasteners intersect the cavity or channel. The fasteners provide a strong mechanical bond between the bracket and the surface. Prior to installation on the surface, a sealant is placed in the cavity or channel to seal the holes in the surface that are engaged by the fasteners. The top side of the bracket base has an attachment surface.

18 Claims, 3 Drawing Sheets

BRACKET ASSEMBLY INCLUDING A RESERVOIR

FIELD OF THE INVENTION

The present invention relates to brackets or mounting devices that are attachable to surfaces. In particular, the invention relates to brackets for mounting to building surfaces where the weather resistance of the building is to be maintained.

BACKGROUND OF THE INVENTION

With the increased use of sheet metal panels in building construction, there has been an increased need to address ways in which various building attachments can be interconnected with a metal panel surface. For instance, there is often a need to attach a sign to the face of a metal panel. Moreover, in the case of metal roofs, there is often a need to mount or secure various types of equipment thereon (e.g., fans, air conditioning units, walkways, signage, facade, ladders, or other equipment). In addition, where a bracket is to be attached to the exterior of a building, or to some other surface where weather resistance must be maintained, it is important to provide a means for sealing the surface after it has been penetrated by fasteners used to secure the bracket to the surface.

Existing brackets for mounting equipment or devices to surfaces often feature a substantially planar surface for contacting the surface to which the bracket will be attached. Generally, to insure a strong mechanical bond to the surface, the bracket is provided with some type of fastener that engages holes formed in the building or other structure or device to which the bracket is being attached. Because the use of screws or other fasteners passing through the surface of the receiving structure compromises the impermeability of that structure, various means have been used to maintain a resistance to rain, wind or other fluids.

Existing means for maintaining weather resistance include the use of gaskets between at least a portion of the bracket surrounding the fasteners and the surface to which the bracket is attached. However, such gaskets can be difficult to install correctly. Incorrectly installed gaskets may allow water or other fluids to leak into the interior of the surface to which the bracket is attached. In addition, the incorrect installation of a sealing gasket may not be evident when the bracket is viewed from an exterior of the structure. Therefore, the incorrect installation of such mounting devices may not become apparent until substantial time has passed and significant damage has occurred to the structure.

As an alternative to fasteners such as screws that pierce the exterior of the structure, mounting brackets have been developed that attach to the surface using only adhesives. Such systems have the advantage of maintaining the impermeability of the attachment surface. However, such systems generally provide a bracket that is less securely attached than one affixed to a surface using fasteners that mechanically hold the bracket to the surface. In part this is due to the fact that the mounting surface of the bracket is not in direct contact with the mounting surface of the structure. Furthermore, such systems benefit from adhesive or glue being applied to the entirety of the bracket's mounting surface. When this is done however, it is common for the adhesive or glue to seep out from under the edges of the bracket's mounting surface. This condition is aesthetically unpleasant. Furthermore, because there is generally at least some small gap between the mounting surface of the bracket and the attachment surface of the structure, it is possible for the bracket to be pried away from the attachment surface relatively easily. Furthermore, fluids may contact the glue or adhesive and gradually weaken it. Over time, the bracket may release from the surface due to such gradual weakening.

An additional method for reliably securing brackets to structures while maintaining the weather resistance of the receiving structure includes the use of a sealant in combination with mechanical fasteners. Typically, such systems employ a threaded fastener, such as a screw, which passes through a mounting surface on the bracket to engage the attachment surface of the structure. Before affixing the bracket to the structure using the fastener, a layer of sealant is typically applied to the bottom of the bracket. The sealant is intended to provide a barrier to prevent water and other fluids from leaking into and through the hole in the structure necessitated by the fasteners. Thus, such systems combine the mechanical strength of brackets attached to structures using threaded fasteners that pass through the exterior of the attachment structure, with improved weather resistance and reduced permeability due to the use of a sealant.

However, such systems are prone to having sealant leak from the beneath the mounting surface of the bracket. This tendency is even more marked than in systems using an adhesive alone, because the mechanical fasteners typically allow a significant amount of force to be applied to the sealant placed between the bracket and the structure. Thus, as the screws or bolts used to hold the mounting bracket to the structure are tightened, the sealant is forced from between the structure and the bracket. Therefore, not only is the final installation unsightly, but little sealant is left beneath the mounting bracket to seal the holes in the structure from penetration by water or other fluids. Another disadvantage with systems which use sealant in combination with mechanical fasteners is that the sealant is typically applied at the work site. This can lead to a number of problems. For example, the sealant may be misapplied. If the sealant is misapplied, the system may be less resistant to moisture infiltration. Another potential problem is that the wrong sealant may be selected and applied, also leading to decreased weather resistance.

Based upon the foregoing, it is apparent that there is a need for a device that can be securely attached to structures while maintaining the weather resistance of such structures. Furthermore, it would be advantageous if such an apparatus were capable of being reliably and easily installed to ensure that its benefits were readily attained. Moreover, there is a need for a device combining these attributes that is inexpensive to manufacture. There is a need for a device in which a sealant can be applied prior to providing the bracket to the installer, e.g., during manufacture, to minimize problems resulting from field-applied sealants.

SUMMARY OF THE INVENTION

The present invention is generally directed towards a bracket assembly that is attachable to a surface to facilitate an interconnection between a member and the surface. Typically, the present invention will be used on an exterior of a building, where the retention of the building's weather resistant qualities is important. However, the device may be used on interior building surfaces, or on any apparatus where the impermeability of the surface of the apparatus must be maintained. Examples include brackets attached to ships, planes, or housings enclosing various types of equipment. Although the present invention will generally be described in regard to attachment to a building surface, it will be appreciated that the invention may be used in connection with any attachment surface.

In one aspect of the present invention, a bracket attachable to a surface is provided having a base portion. The base has first and second sides, the first side of which has a peripheral portion extending to a plane, and a center portion that is recessed from the plane described by the peripheral portion. The space enclosed by the peripheral portion of the first side of the base describes a volume. Extending from the second side of the bracket base is an attachment surface. In one embodiment, the attachment surface is adapted to receive a member. In a preferred embodiment, the bracket is provided with a sealant in an amount to substantially fill the volume of the center portion of the first side of the base. In a most preferred embodiment, the base of the mounting bracket is provided with a hole for receiving a threaded fastener, the hole being located within the periphery of the first side of the base, such that the fastener will be surrounded by sealant within the volume of the center portion of the base.

In an additional embodiment of the present invention, a bracket is provided having a periphery on two sides only of a recessed center portion of the base. In a further alternative embodiment, the mounting bracket is manufactured from a single piece of aluminum.

In another aspect of the present invention, a component for a building surface is provided having a base. The base has at least first and second sides, and a channel on a first side of the base. The component further features a hole through the first and second sides of the base and extending through the channel formed on the first side of the base. The component further features a first member integral to and located on the second side of the base that is adapted for receiving a second member. A fastening member extends from the second side of the base, through the hole to fixedly engage the surface to which the component is attached. In a preferred embodiment, the component is provided with sealant in an amount to substantially occupy the channel of the base, whereby the resistance of the surface to penetration by water is maintained when the component is fixed to the surface. In a more preferred embodiment, the sealant provided is a butyl tape sealant. In a most preferred embodiment, the fastening member is a screw.

In an additional embodiment, an apparatus for mounting to a surface is provided having a base with bottom and top sides. The bottom side is provided with at least two side walls, and a cavity is located between the side walls. The apparatus is further provided with a bracket member on the top side, wherein the bracket member is adapted to be interconnected to another member. In a preferred embodiment, the apparatus is provided with a sealant located in the channel. In a more preferred embodiment, the apparatus is additionally provided with at least one fastening member extending from the central cavity of the bottom of the base for engaging the surface. In a most preferred embodiment, the fastening member of the apparatus is a screw.

In a further embodiment of the present invention, a method for attaching a bracket to a surface is provided. This method includes providing a bracket having a volume on a first surface, and substantially filling that volume with a sealant. The method further includes providing a fastener extending from a central portion of the reservoir, such that the fastener passes through at least a portion of the sealant. According to the method, the bracket is then affixed to the building surface with the fastener, allowing the sealant to seal a hole in the surface created by the fastener, preventing water from passing from an exterior of the building surface through the hole to an interior of the building surface. In a more preferred embodiment, the method includes creating a hole in the surface adapted to receive the fastener, and positioning the bracket and fastener over the hole. In a most preferred embodiment, the method includes the further step of attaching an apparatus to the bracket.

DETAILED DESCRIPTION

In accordance with the present invention, an apparatus and method for attaching a bracket to a surface, while maintaining the weather resistance of that surface, is provided. In particular, the present invention is directed to securing brackets to building surfaces.

Figure 1:
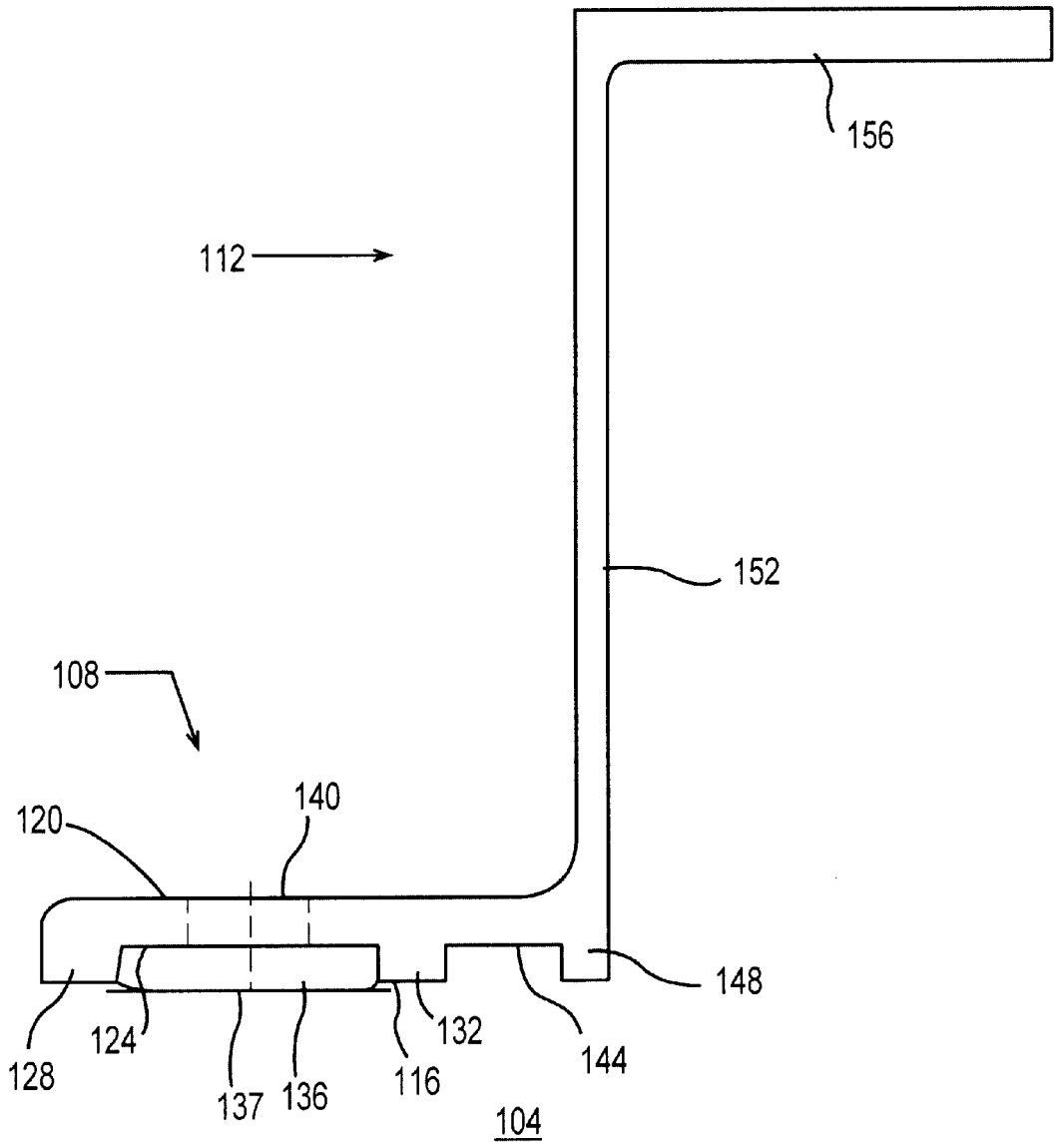
FIG. 1 is an end on view of a bracket attachable to a surface according to one embodiment of the invention.

With reference to FIG. 1, an apparatus constructed in accordance with one embodiment of the present invention is generally identified as bracket 104. The bracket 104 generally includes a base portion 108 and an attachment portion 112.

The base portion 108 has a first or bottom side 116 and a second or top side 120. The first side 116 of the base portion 108 has a channel 124 formed between a first raised portion 128 and a second raised portion 132. Affixed to the first side 116 of the base portion 108 is a butyl sealant tape 136, sized such that it occupies a volume slightly larger than that described by the channel 124. Although a preferred sealant is butyl tape, any appropriate sealant can be employed. Preferably the sealant is a non-curing sealant such as those made. from butyl compounds. Preferred sealants include polyisobutylenes and polyisobutylene isoprene copolymer sealants. Holes 140 are provided in the base portion 108 for receiving fasteners (not shown).

The embodiment illustrated in FIG. 1 also features a second channel 144 on the first side 116 of the base portion 108. The second channel 144 and the raised portion 148 are not essential elements of the invention. However, the second channel 144 and the raised portion 148 enhance the manufactureability and stability of the mounting bracket 112 where the base portion 108 is relatively wide, as in the embodiment illustrated in FIG. 1. In alternative embodiments, particularly those having a narrower base portion 108, the second channel 144 and the raised portion 148 need not be provided.

Extending from the second side 120 of the base portion 108 is the attachment portion 112. The attachment portion 112 of the mounting bracket 104 generally includes a riser 152 and a shelf 156. However, other configurations of the attachment portion 112 are encompassed by the present invention, and the configuration illustrated in FIG. 1 is only intended to be an illustration of one possible configuration. The specific configuration of the attachment portion 112 will be determined by the characteristics of any apparatus that is to be attached to the bracket 104, as well as by manufacturing methods and economics.

Figure 2:
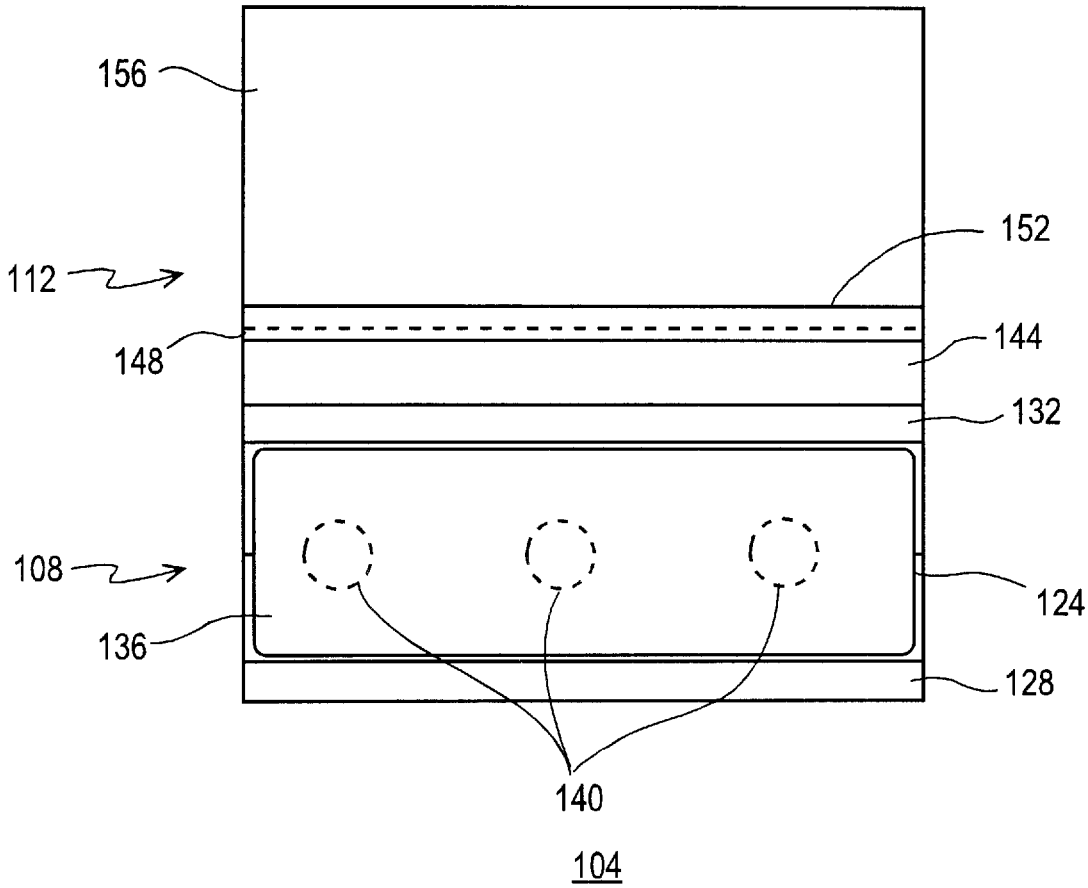
FIG. 2 is a bottom view of the embodiment of FIG. 1.

Referring now to FIG. 2, a bottom view of the mounting bracket 104 is shown. In particular, FIG. 2 illustrates the positioning of the holes 140 provided in this embodiment of the mounting bracket 104. Specifically, the holes 140 are located such that they extend through the channel 124 of the base portion 108 of the mounting bracket 104. In the embodiment shown, the holes 140 are arrayed along a line. However, the number and positioning of the holes 140 may vary. Although the number and the exact positioning of the holes 140 may vary, it is preferable that they intersect with the channel 124 of the base portion 108. This is because superior sealing is achieved when the sealant 136 completely surrounds the fasteners (not shown) that pass through the holes 140 to secure the mounting bracket 104 to the building surface.

In a preferred embodiment the sealant is applied prior to shipping the brackets to the work site. For example, the sealant may be applied when the bracket is manufactured. For ease of handling and shipping, the exposed (i.e., bottom or portion of the sealant which does not contact the recessed channel) surface of the sealant may be covered. For example, release paper 137 may be provided on the exposed surface of the sealant. Preferably, the release paper 137 covers the entire exposed surface and extends slightly beyond the edges of the channel. By pre-applying the sealant, problems associated with misapplied sealant or the use of the wrong sealant at the work site are reduced. However, even though it is preferred to pre-apply the sealant, the provision of a channel reduces the chances of misapplied sealant, even when it is applied at the work site. This is because a worker, even if unfamiliar with the product, will typically be able to fill the channel with sealant. In this way, proper sealing around the fastener holes can be achieved when the bracket is installed.

To install the mounting bracket 104 on a building surface, a sealant, such as butyl sealant tape, is affixed to the channel 124 of the mounting bracket 104. As discussed above, the sealant is preferably applied during manufacture of the device, although it may also be applied at the work site. If a covering has been provided over the bottom surface of the sealant, such as release paper, it is removed prior to installation. The mounting bracket is then ready for surface, or that are drilled in the building surface before or during affixation of the mounting bracket 104. Once the mounting bracket 104 has been correctly aligned, fasteners (not shown) are passed through the holes 140 to engage corresponding holes in the building surface. Where holes are not already provided in the building surface, they may be created by self-tapping or self-drilling fasteners. Appropriate fasteners for this device include, but are not limited to, lag screws, bolts, screws, nails, rivets, or spikes. Upon placement in and through the holes 140, the fasteners will be surrounded by the sealant 136. The sealant 136 preferably is in closely fitting contact with the fasteners, and securely pressed between the building surface on a first side and the base portion 108 of the bracket 104 on a second side. In this way, penetration by water or other fluids into the hole or holes receiving the fasteners is prevented.

The bracket 104 may be securely affixed to the building surface using the fasteners, without concerns that the integrity of the seal formed between the bracket and the surface will be damaged by excessive tightening of the fasteners. This is because the force placed on the top 120 of the base portion 108 of the mounting bracket 104 is borne in substantial part by the raised portions 128 and 132 on either side of the channel 124. Typically, the limit on the force that can be applied to the base portion 108 of the mounting bracket 104 through the fasteners is a function of the material engaged by the fasteners, or of the fasteners themselves.

Figure 3:
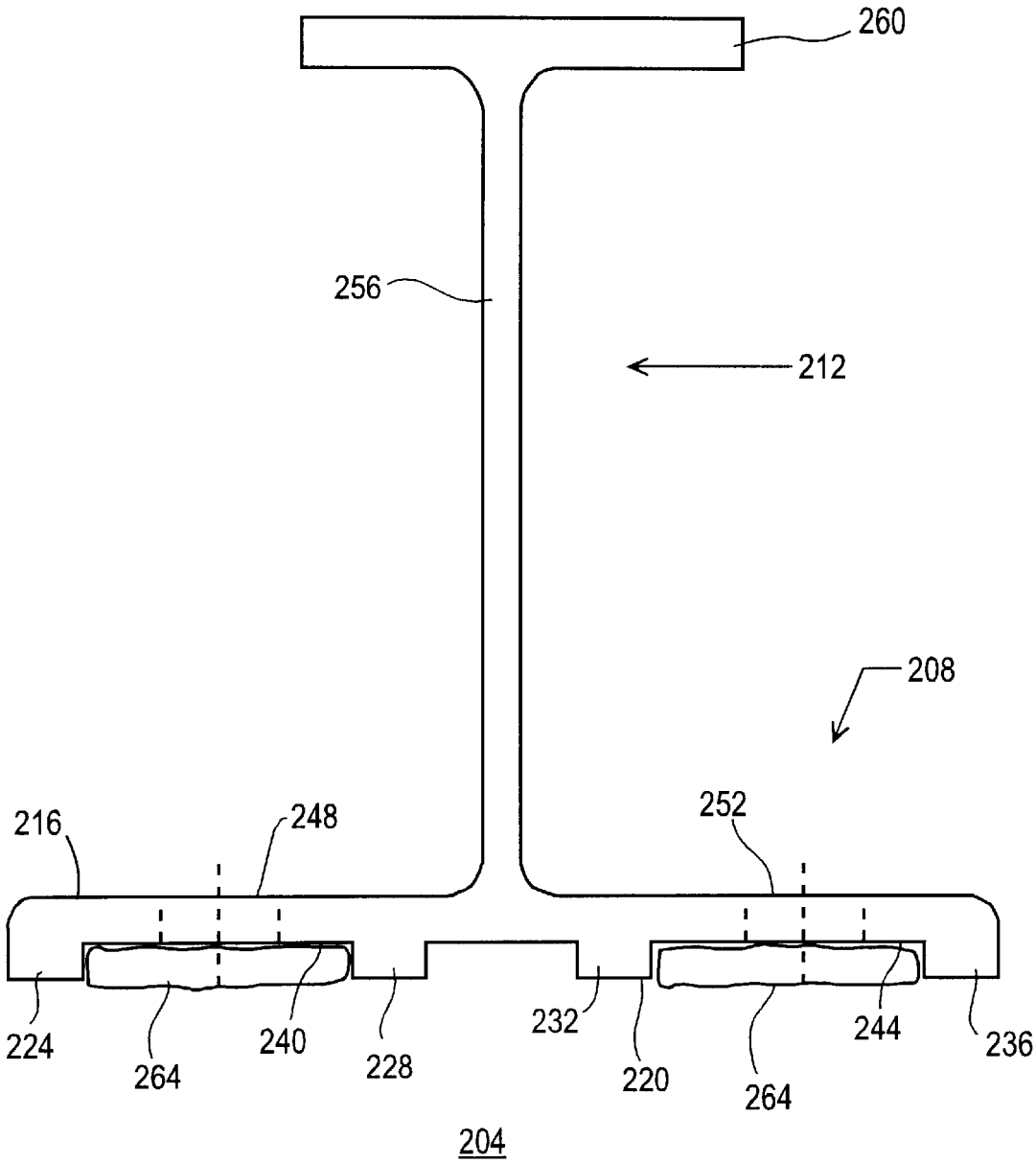
FIG. 3 is an end on view of a bracket attachable to a surface according to an embodiment of the present invention.

Referring now to FIG. 3, an additional embodiment of the present invention, identified generally as mounting bracket 204, is illustrated. The mounting bracket 204 generally includes a base portion 208 and an attachment portion 212. The base portion 208 has a top side 216 and a bottom side 220. The bottom side 220 features raised portions 224, 228, 232, and 236. Between raised portion 224 and raised portion 228 is a first channel 240. Similarly, between raised portion 232 and 236 is a second channel 244. The base portion 208 has holes 248 extending from the top side 216 to the bottom side 220, positioned such that they intersect the first channel 240. Similarly, holes 252 extend from the top side 216 to the bottom side 220, positioned such that they intersect the second channel 244.

Extending from the base portion 208 is the attachment portion 212. The attachment portion 212 generally includes an upright 256 and a shelf 260. The exact dimensions and configuration of the attachment portion 212 will vary, depending on the devices to be affixed to the building surface via the mounting bracket 204, or the use to which the bracket 204 is to be put.

The mounting bracket 204 preferably is provided with strips of butyl sealant tape 264, positioned within the channels 240 and 244. As an alternative to providing sealant tape 264, a viscous sealant may be placed in the channels 240 and 244 prior to the installation of the mounting bracket 204 on a building surface.

In a preferred embodiment, the mounting brackets 104 and 204 are formed from aluminum. In a further preferred embodiment, the mounting brackets 104 and 204 are formed by extrusion of aluminum. Aluminum is a preferred material because it is lightweight, relatively easy to form, suitably strong for most applications, and resistant to corrosion. Other suitable materials for mounting brackets according to the present invention include carbon and stainless steel, brass, iron and other metals, plastics, composites, wood or ceramics.

In one embodiment, the mounting bracket 104 of the present invention has a base portion 108 that is approximately 1.6" wide, 3" long, and a thickness of approximately ¼". At the channel 124, the base portion 108 is approximately ⅛"thick. There are three holes 140 arrayed along a line centered between the raised portions 128 and 132 of the base portion 108 that form the channel 124. These holes have a diameter of approximately ¼". The riser 152 has a height of approximately 2½", is approximately 3" long, and has a thickness of approximately ⅛". The shelf 156 also has a thickness of about ⅛" and a width of about 1¼". The shelf 156 is also about 3" long. According to a preferred embodiment, the sealant 136 is a butyl tape positioned in the channel 124 prior to distribution to consumers, and is approximately ⅛" thick, ¾" wide, and 3" long. The channel 124 is slightly less than ¾" wide.

According to one embodiment of the mounting bracket 204 of the present invention, the base portion 208 is approximately 2¾" wide and the channels 240 and 244 are each slightly less than ¾" wide. The holes 248 and 252 that intersect channels 240 and 244 are each approximately a ¼" in diameter. According to this embodiment, there are three holes intersecting each of the channels 240 and 244. The base portion 208 is approximately ¼" thick at the raised portions 224, 228, 232 and 236. At the channels 240 and 244, the base portion 208 is approximately ⅛" thick. The riser 256 extends approximately 2½" from the base portion 208 and is approximately ⅛" thick. The shelf 260 is approximately 1¼" wide and is also approximately ⅛" thick. The entire bracket 204 is approximately 3" long. In a preferred embodiment, the sealant 264 is provided at the factory in the form of butyl tape.

Of course, brackets may be provided having a wide variety of attachment portions. For example, the attachment portion of a bracket intended as an anchor for a lifeline or a guy wire may be in the general shape of an eye-bolt. As another example, a bracket intended to form a ladder rung may have two base portions interconnected by an attachment portion formed from a U-shaped piece of circular metal.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A roof assembly that comprises:

a roof;

a bracket, wherein said bracket comprises:

a base comprising first and second opposing sides, wherein said first side comprises first and second protrusions that are disposed in spaced relation and that are disposed on and engage said roof, as well as a first recessed surface that extends between said first and second protrusions and that is disposed in spaced relation to said roof; and an attachment member that is interconnected with and extends away from said second side of said base;

a first sealant disposed within a first cavity that is defined by said first and second protrusions and said first recessed surface of said bracket, as well as said roof;

a first fastener that extends through said bracket at a location that is between said first and second protrusions, through said first sealant in said first cavity, and into said roof; and a first member attached to said attachment member.

2. The roof assembly of claim 1, wherein:

said first side further comprises a third protrusion that is spaced from said second protrusion such that said second protrusion is located between said first and third protrusions, wherein said first side further comprises a second recessed surface that extends between said second and third protrusions, wherein said second recessed surface is free of any bracket fastener hole, and wherein said third protrusion also interfaces with roof so as to dispose said second recessed surface in spaced relation to said roof.

3. The roof assembly of claim 1, wherein:

a thickness of said base from said second side to said first side at said first and second protrusions is about ¼ inch, and wherein a thickness of said base from said second side to said first side at a location that is between said first and second protrusions is about ⅛ inch.

4. The roof assembly of claim 1, wherein:

said first side further comprises third and fourth protrusions that are disposed in spaced relation, a second recessed surface that extends between said third and fourth protrusions, wherein said third and fourth protrusions are located on said first side such that said third protrusion is located between said second and fourth protrusions, and wherein said third and fourth protrusions also interface with said roof so as to dispose said second recessed surface in spaced relation to said roof.

5. The roof assembly of claim 4, further comprising:

a second sealant disposed within a second cavity that is defined by said third and fourth protrusions and said second recessed surface of said bracket, as well as said roof, wherein said roof assembly further comprises a second fastener that extends through second fastener hole in said bracket, through said second sealant, and into said roof.

6. The roof assembly of claim 4, wherein:

said attachment member comprises a riser and a shelf, wherein said riser disposes said shelf in spaced relation to said second side of said base, and wherein said riser extends away from said second side of said base at a location that is between said second and third protrusions.

7. The roof assembly of claim 1, wherein:

said attachment member comprises a riser and a shelf, wherein said riser disposes said shelf in spaced relation to said second side of said base.

8. The roof assembly of claim 7, wherein:

said base comprises first and second edges that are disposed in spaced relation, wherein said first protrusion is disposed along said first edge, wherein said riser extends away from said second side of said base at a location along said second edge.

9. The roof assembly of claim 1, wherein:

said first sealant fills said first cavity that is defined by said first and second protrusions and said first recessed surface of said bracket, as well as said roof.

10. The roof assembly of claim 9, wherein:

said first sealant is a non-curing sealant.

11. The roof assembly of claim 9, wherein:

said first sealant is selected from the group consisting of polyisobutylenes, polyisoprenes, and copolymers thereof.

12. The roof assembly of claim 1, wherein:

said first sealant is a butyl tape sealant.

13. The roof assembly of claim 1, wherein:

said base and said attachment member are an extrusion.

14. A bracket that is attachable to a first surface and that comprises:

a base comprising first and second opposing sides, wherein said first side comprises first and second protrusions that are disposed in spaced relation, a first recessed surface that extends between said first and second protrusions, and at least one first fastener hole that extends entirely through said base from said second side to said first side at a location that is between said first and second protrusions and thereby through said first recessed surface, wherein said first and second protrusions are adapted to interface with said first surface when said bracket is attached to said first surface so as to dispose said first recessed surface in spaced relation to said first surface; and an attachment member that is interconnected with and extends away from said second side of said base, wherein a first member can be attached to said attachment member when said bracket is attached to said first surface so as to interconnect said first member with said first surface, wherein said first side further comprises a third protrusion that is spaced from said second protrusion such that said second protrusion is located between said first and third protrusions, wherein said first side further comprises a second recessed surface that extends between said second and third protrusions, wherein said second recessed surface is free of any bracket fastener hole, and wherein said third protrusion also interfaces with said first surface when said bracket is attached to said first surface so as to dispose said second recessed surface in spaced relation to said first surface.

15. A bracket that is attachable to a first surface and that comprises:

a base comprising first and second opposing sides, wherein said first side comprises first and second protrusions that are disposed in spaced relation, a first recessed surface that extends between said first and second protrusions, and at least one first fastener hole that extends entirely through said base from said second side to said first side at a location that is between said first and second protrusions and thereby through said first recessed surface, wherein said first and second protrusions are adapted to interface with said first surface when said bracket is attached to said first surface so as to dispose said first recessed surface in spaced relation to said first surface; and an attachment member that is interconnected with and extends away from said second side of said base, wherein a first member can be attached to said attachment member when said bracket is attached to said first surface so as to interconnect said first member with said first surface, wherein said first side further comprises third and fourth protrusions that are disposed in spaced relation, a second recessed surface that extends between said third and fourth protrusions, and at least one second fastener hole that extends entirely through said base from said second side to said first side at a location that is between said third and fourth protrusions and thereby through said second recessed surface, wherein said third and fourth protrusions are located on said first side such that said third protrusion is located between said second and fourth protrusions, and wherein said third and fourth protrusions also interface with said first surface when said bracket is attached to said first surface so as to dispose said second recessed surface in spaced relation to said first surface.

16. The bracket of claim 15, further comprising:

a first sealant disposed within a space that is defined by said first and second protrusions and said first recessed surface, and a second sealant disposed within a space that is defined by said third and fourth protrusions and said second recessed surface.

17. The bracket of claim 15, wherein:

said attachment member comprises a riser and a shelf, wherein said riser disposes said shelf in spaced relation to said second side of said base, and wherein said riser extends away from said second side of said base at a location that is between said second and third protrusions.

18. A bracket assembly that comprises:

a base comprising first and second opposing sides, wherein said first side comprises first and second protrusions that are disposed in spaced relation, as well as a first recessed surface that extends between said first and second protrusions;

an attachment member that is interconnected with and extends away from said second side of said base, wherein a first member can be attached to said attachment member; and a first sealant disposed within a cavity that is defined by said first and second protrusions and said first recessed surface of said bracket; and a removable material covering an exposed surface of said first sealant, wherein said removable material may be removed prior to attaching said bracket assembly to a first surface, and wherein said first sealant bulges beyond a reference plane that contains end portions of said first and second protrusions.

* * * * *